US005984588A

United States Patent [19]

Ferrari

[11] Patent Number: 5,984,588

[45] Date of Patent: Nov. 16, 1999

[54] METHOD FOR THE STABILIZATION OF ROCK MASSES AND RELATED STABILIZATION ELEMENT

[75] Inventor: Roberto Ferrari, Gazoldo Ippoliti, Italy

[73] Assignee: Marcegaglia S.p.A., Gazoldo Ippoliti, Italy

[21] Appl. No.: 08/943,297

[22] Filed: Oct. 14, 1997

[30] Foreign Application Priority Data

Mar. 7, 1997 [IT] Italy ..... MI9700518

[51] Int. Cl.[6] ..... E21D 20/02; E21D 21/00

[52] U.S. Cl. ..... 405/259.5; 405/269

[58] Field of Search ..... 405/259.1, 259.5, 405/266, 269

[56] References Cited

U.S. PATENT DOCUMENTS

| | | | |
|---|---|---|---|
| 3,494,133 | 2/1970 | Ahlgreen et al. | 405/259.5 |
| 4,461,600 | 7/1984 | Norkus et al. | 405/259.5 |
| 4,661,022 | 4/1987 | Seegmiller | 405/259.5 |
| 4,946,314 | 8/1990 | Gruber | 405/260 |
| 4,968,185 | 11/1990 | Leibhard et al. | 405/260 |
| 5,052,861 | 10/1991 | Hipkins, Sr. | 405/261 |
| 5,378,087 | 1/1995 | Locotos | 405/259.5 |
| 5,441,372 | 8/1995 | Wilkinson | 405/259.5 X |
| 5,653,557 | 8/1997 | Gruber | 405/259.5 |
| 5,730,565 | 3/1998 | Hein et al. | 405/259.5 X |
| 5,791,824 | 8/1998 | Radtke | 405/259.5 |

*Primary Examiner*—David Bagnell
*Assistant Examiner*—Tara L. Mayo
*Attorney, Agent, or Firm*—Bucknam and Archer

[57] ABSTRACT

Method for the stabilisation of rock masses, especially vaults or walls of tunnels being excavated, comprising the insertion of a hollow tubular element (10) having an open top and provided with at least a spiral-shaped conical-development element (20, 26) within a hole (22) drilled in the rock mass (28) to be consolidated, and the pressure-injection of consolidation material (30) in the cavity of said hollow tubular element (10).

The external diameter of said hollow tubular element (10) is smaller than the maximum hole diameter (22) by a length preferably comprised between 20 and 55 mm.

16 Claims, 3 Drawing Sheets

METHOD FOR THE STABILIZATION OF ROCK MASSES AND RELATED STABILIZATION ELEMENT

BACKGROUND OF THE INVENTION

1. Field of the Invention

The present invention relates to a method for the stabilization of rock masses and the related stabilization element used for the purpose.

More particularly, the present invention relates to a method for the stabilization of rock masses in correspondence of the vault and/or sides of tunnels obtained by drilling.

2. Description of the Prior Art

As is known, in the construction of roads or railways it is often necessary to drill the ground, creating a tunnel, when a natural obstacle is found, constituted, for instance, by a mount relief or a rock spur. According to the nature of the grounds gone through, tunnels are provided with lining of various kinds and the just excavated passages are reinforced and stabilized by means of provisional supports. At present, for the consolidation of tunnels tubular elements of a remarkable length and close front are widespread; said elements are inserted into corresponding holes drilled in the rock by means of special rock-boring machines. In said tubular elements, the fluid determines the elastic deformation of the tubes, which adhere to the hole walls, following their substantially irregular profile.

Said known system of rock mass consolidation has several drawbacks associated especially to the high cost of the equipment used for the deformation of the tubular elements. Besides, said deformation is unavoidably limited and requires therefore the use of a high number of tubular elements to realize an adequate consolidation of the rock mass. The same elastic deformation of the elements reduces the resistance effect of the same, especially in correspondence of the most expanded zones; therefore, the system as a whole is not suitable for all kinds of grounds.

According to another technique of the known art, the consolidation of rock masses is obtained by means of untreated steel rods which are inserted into holes drilled in the rock mass; sideways of the bars, two tubes are placed, respectively for the injection and the bleed of consolidation mortar. This system has a main drawback associated to the weight of the rods, which, besides, do not show a high rigidity because of their great weight. As a consequence, the same rods enter with difficulty the holes drilled in the rock. Besides, this technique involves necessarily the use of two tubes to be placed near each rod.

Therefore, also this system is unsatisfactory because of both the obtained effect and the cost and complexity of the operations and the apparatuses.

SUMMARY OF THE INVENTION

Object of this invention is to obviate the aforesaid drawbacks.

More particularly, the main object of this invention is to provide a method for the stabilization of rock masses, especially vaults and side walls of tunnels, of easy application and such as to ensure an effective and long-lasting rock consolidation.

A further object of the invention is to provide a method as defined above, such as not to require the use of complicated and expensive equipments, comprising, besides, stabilization means particularly resistant to traction and ultimate tensile stresses.

According to this invention, these and still other objects are achieved by a method for the stabilization of rock masses, applicable in particular for the consolidation of vaults and/or side walls of tunnel being excavated, comprising the following steps:

drilling of a hole in the rock mass to be consolidated;

insertion in said hole of a high resistance hollow tubular element having a diameter smaller than the diameter of the hole and provided on its external surface with at least a spiral-shaped conical-development element; said hollow tubular element having a top, inserted in said hole, open, and a bottom, protruding from said hole, provided with a locking means and a feed head, and pressure-injection into the cavity of said tubular element of a consolidation material which distributes uniformly in said cavity, comes out from the open top and fills the gap comprised between the external surface of said tubular element and the wall of the hole.

The external diameter of the hollow tubular element is smaller than the maximum diameter of the hole by at least 18 mm, preferably by a length comprised between 20 and 50 mm.

Each spiral-shaped conical-development element, fixed to the external surface of the hollow tubular element, is formed by coils, approached to one another or spaced from one another, having an increasing diameter from the upper to the bottom ends of the hollow tubular element.

The hollow tubular element used as a stabilization means, which is also the subject matter of the present invention, comprises: a hollow tubular metal body, preferably from hardened and tempered steel, having at least an open end and the opposite end provided with a locking means and a feed spring and at least spiral-shaped conical-development element, composed of coils spaced from one another or approached to one another, and having an increasing diameter from the open end of the tubular body towards the end provided with a locking means, said spiral-shaped element being fixed to the external surface of said tubular metal body.

DESCRIPTION OF THE DRAWINGS

The method for the stabilisation of rock masses and the related stabilization tubular element used will be better understood thanks to the following detailed description which makes reference to the attached drawings which represent a preferred embodiment of this invention, and wherein.

DETAILED DESCRIPTION OF THE INVENTION

Figure 1:
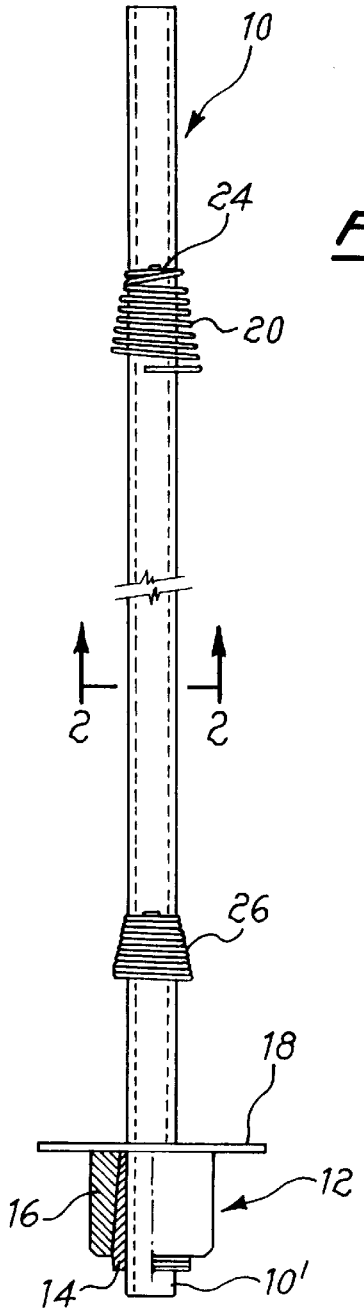
FIG. 1 is a schematic, partly sectioned side view of the tubular stabilization element used in the method for the stabilisation of rock masses of this invention.
Figure 2:
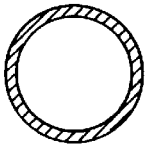
FIG. 2 is the schematic view of a cross-section of the tubular stabilization element obtained by a plane passing along the 2—2 line of FIG. 1.

With reference to said figures, the tubular stabilization element utilised in the stabilisation method of the present invention may be, for instance, a hollow bar bolt, comprising a hollow body 10 having the shape of a rectilinear tube having preferably a round section, made from steel submitted to hardening and tempering treatments, and having the following mechanical characteristics: TS=900/1700 N/mm$^2$; YS=700/1500 N/mm$^2$; El=7–11%. This type of hardened or tempered steel is marketed under the marks: CID, 20MNB5, 22MNB5, etc.

Said hollow body 10 has a side extension comprised between 16 and 60 mm, and a thickness comprised between 1.2 and 8 mm, preferably between 3 and 5 mm. The bottom of hollow body 10, which remains outside hole 22, is coupled to a locking means 12, of a known type, made up by a conical ring 14, a sleeve 16 and a metal plate 18. To the external surface of hollow body 10, near its top to be inserted into hole 22, a spiral-shaped conical-development element 20 is connected, which acts as a retaining-truing means for the tubular element in hole 22 drilled in the rock. Preferably, said spiral-shaped element is formed by coils slightly spaced from one another, and is caused to be integral with hollow body 10 by welding in correspondence of the smaller diameter coil 24. An additional spiral-shaped conical-development element 26 is preferably connected by a like welding near the bottom of hollow body 10. Said additional spiral-shaped element 26, wherein coils are preferably developed in touch with one another, defines as a whole a spring that retains the tubular element in hole 22, allowing at the same time air bleeding when the consolidation material is injected in said hole.

In the rock mass, indicated by 28, a hole 22 is drilled having, with respect to hollow body 10, a diameter greater by at least 18 mm, preferably about 20–50 mm. Hole 22, obtained with boring machines of a known type develops in the rock mass 28 for an extent shorter than the length of hollow body 10, so that the bottom of the latter protrudes from said hole. Said bottom protruding from the hole is threaded and the locking means 12 is connected to the same. Hollow body 10 can be inserted in hole 22 by means of known mechanical loaders, or by hand. The spiral-shaped elements 20 and 26, integral with the external surface of said hollow body, are as many means for the starting truing at the time of the insertion of said hollow body in hole 22. Said spiral-shaped elements 20 and 26 also allow the temporary stabilization in the housing of the hollow body before the introduction of the consolidation material, hooking to the wall of the rock mass with their widest part which prevents their corning out. Following such calibrated insertion, hollow body 10 protrudes from hole 22 with its threaded bottom. The locking means 12 is connected to said threaded bottom by placing plate 18 in touch with the rock mass that defines perimetrically said hole and pushing said plate 18 towards the rock mass by screwing the conical ring 14 and sleeve 16.

In order to allow an easy coupling of the locking means 12 at the bottom of hollow body 10, said hollow body protrudes from hole 12 by a length indicatively comprised between 10 and 70 mm. The connection between the locking means 12 and the exposed bottom of bolt 10 is obtained by screwing sleeve 16 before the conical ring 14, whose inner surface, which gets in touch with bolt 10 is preferably serrated, to obtain a more effective adhesion and tightness. The bottom 10' of hollow body 10 protrudes from the locking means 12 coupled to same for a minimum length, sufficient to realize the connection to a traditional feed head or injector 34 of the consolidation material, for instance mortar, cement and/or thixotropic grout, injection resin, etc. Said material, indicated by 30 in FIGS. 3 and 4, distributes uniformly along the cavity of hollow body 10, comes out of the same through the open top and falls down externally, filling the gap defined by the external surface of the hollow body and the wall of hole 22.

Figure 3:
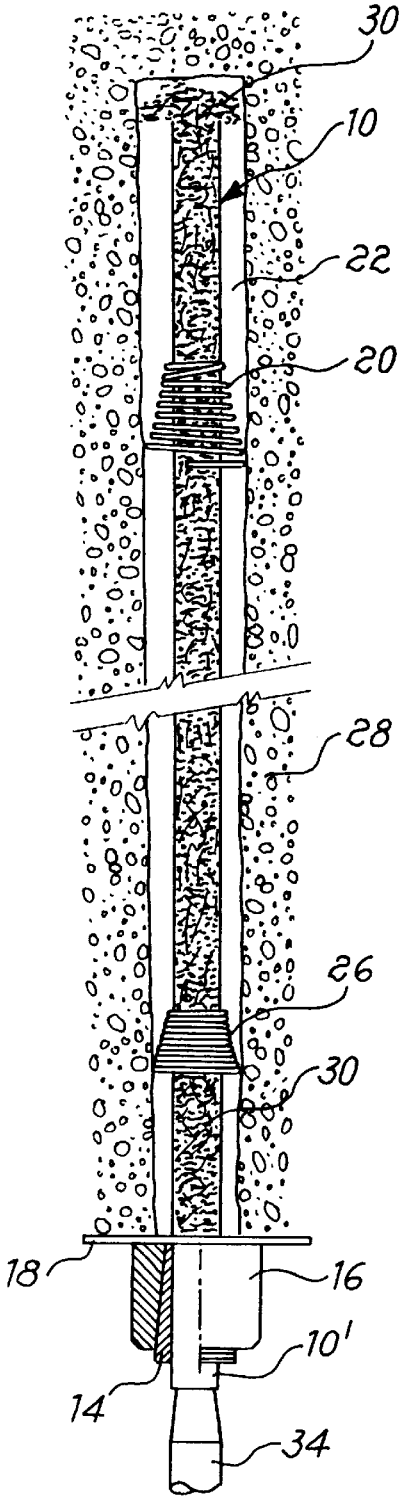
FIG. 3 is the schematic view of the tubular stabilization element inserted into a hole drilled in the rock mass, and filled with consolidation material, such as for instance mortar.
Figure 4:
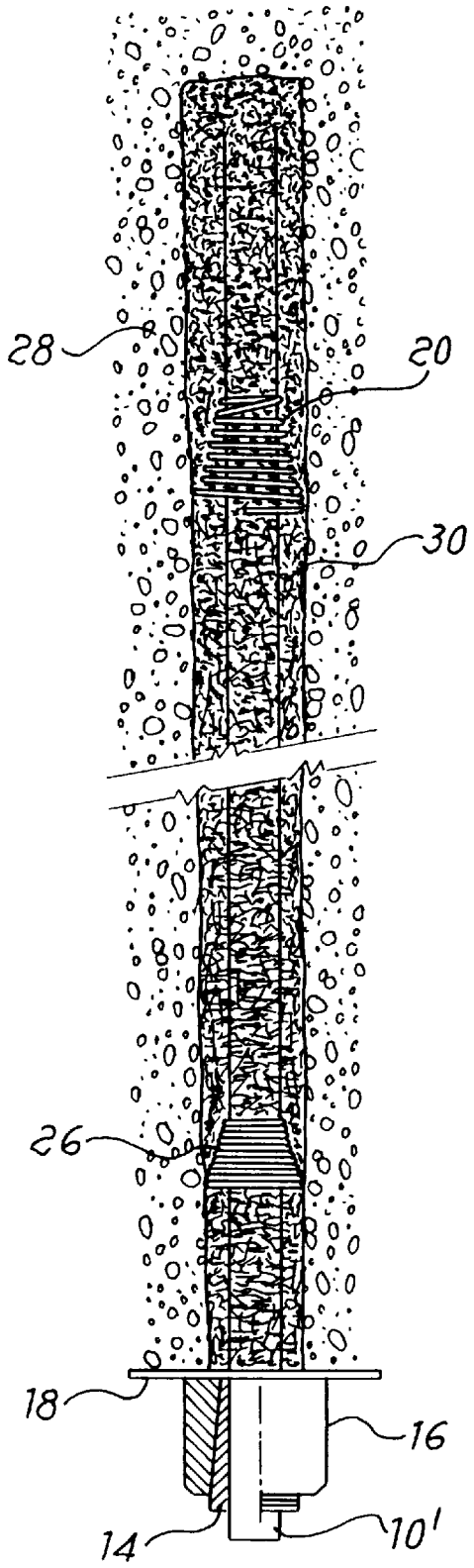
FIG. 4 is the schematic view of the tubular stabilisation element at the end of the stabilization operation, with the consolidation material placed in the inside of said element and externally in the gap defined by the hole wall and the external surface of said tubular element.

FIG. 3 shows, by way of example, the condition in which the consolidation material 30 has entirely filled the cavity of hollow body 10 and comes out at the top of said cavity to distribute along hole 22. Instead, FIG. 4 shows the condition that realizes upon conclusion of the filling: the material 30, having come out from the top of hollow body 10, has entirely spread throughout and filled the cavity comprised between the external surface of said hollow body and the wall of hole 22.

During the injection of the consolidation material 30, which preferably takes place at a pressure comprised between 5 and 50 bar, the upper spiral-shaped element 20 keeps bolt 10 trued and fixed, while the lower spiral-shaped element 26, besides performing a like function relative to the preceding one, allows the the adequate air bleeding, preventing at the same time large quantities of material 30 from flowing and coming out from the opposite front, in correspondence of plate 18. Upon completion of the injection of material 30, the locking means 12 may be removed by hand.

The external surface of hollow body 10 may be provided with protrusions or extensions of any form and development, and/or a continuous or discontinuous threading, to improve the adhesion of the consolidation material 30.

Figure 5:
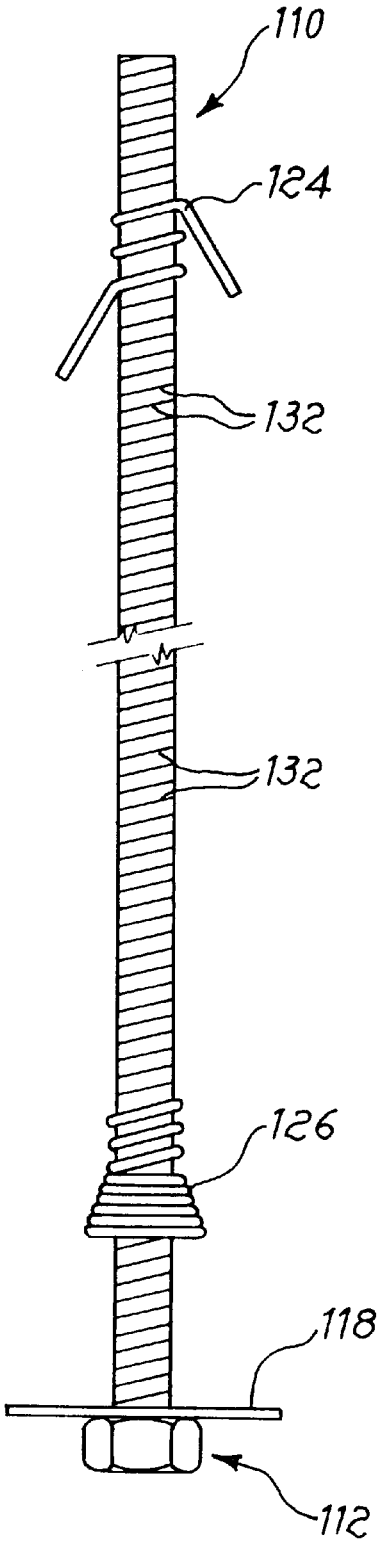
FIG. 5 is the schematic side view of an alternative embodiment of the tubular stabilization element with the external surface provided with a screw pitch.

Said protrusions, as shown by way of example on FIG. 5, may be advantageously constituted by a screw pitch 132, obtained by rolling hollow body 110; in this case, rolling, besides bringing about an improved adherence, allows to fix by screwing the spiral-shaped elements 124 and 126 and the locking head 112.

As can be understood from what has been said hereabove, the advantages the method of this invention reach are obvious. In fact, the method of this invention allows the effective and easy consolidation and stabilization of rock masses without requiring the use of complex technologies and expensive equipment.

Particularly advantageous is the possibility of obtaining said consolidation and stabilization without having to make structural modifications of stabilization elements during their application. Besides, said method ensures the complete filling of the hole, as the consolidation material goes down in the same by dropping, starting from the top which corresponds to the outlet of hollow body 10, and when the consolidation material comes out from the opposite front, corresponding to plate 18, one is sure that the hole filling is complete.

The use of special steels, such as for instance those mentioned above, submitted to tempering or hardening treatments for the realization of said tubular stabilization elements, ensures their optimum resistance to compression and/or traction stresses.

Even though the present invention has been described with reference to an embodiment expounded by way of non limitative example, many modifications and changes may be introduced in its practical realisation, without departing from the protection scope of the attached claims.

For instance, the spiral-shaped elements connected to the hollow body used in the stabilization method may show configuration, number, development and/or location other than those described and illustrated by way of example.

Besides, the external surface of said hollow bodies may be provided with protrusions or extensions of any form, development and section, or radial opening, either extended or circumscribed in pre-fixed zones, to cause the coming out of the consolidation material in several points.

Additionally, the method of the present invention, although referred in particular to the stabilization of rock masses and more specifically, to the consolidation of tunnel vaults or walls, can be used, with a suitable sizing of hollow bar bolts and/or the utilization of suitable filling materials, also for applications in other fields, such as for instance the stabilization of load-bearing structures, soils and foundations.

I claim:

1. A method for the stabilization of rock masses, for the consolidation of vaults and side walls of tunnels being excavated, comprising the following steps:

drilling a hole (22) in the rock mass (28) to be consolidated;

inserting in said hole (22) a hollow high resistance tubular element (10) having a diameter smaller than the diameter of the hole (22) and provided on its external surface with at least one spiral-shaped conical-development element (20,26), said hollow tubular element (10) having an open top inserted into said hole and a bottom (10') protruding from said hole (22) provided with a locking means (12); and pressure injecting a consolidation material via a feed head (34) into the cavity of said tubular element (10) which is distributed uniformly in said cavity, emerges from the open top and fills the gap between the external surface of said tubular element (10) and the wall of the hole (22) facilitated by said at least one spiral-shaped conical development element (20, 26).

2. The method according to claim 1, wherein the step of pressure injecting said consolidation material (3) includes injecting said consolidation material at a pressure between 5 and 50 bar.

3. The method according to claim 1, wherein the diameter of the hole (22) drilled in the rock mass (28) to be consolidated is greater by at least 18 mm than the external diameter of the tubular element (10).

4. The method according to claim 1, wherein the diameter of the hole (22) drilled in the rock mass (28) to be consolidated is greater by 20 to 50 mm than the external diameter of the tubular element (10).

5. The method according to claim 1, wherein the longitudinal extension of the hole (22) is smaller than the length of the hollow tubular element (10), and said hollow tubular element protrudes from the hole by a length between 10 and 70 mm.

6. The method according to claim 1, wherein the consolidation material (30) is chosen from the group consisting of mortar, cement and/or thixotropic grout and an injection resin.

7. The method according to claim 1, wherein the hollow tubular element (10) is provided with a first spiral-shaped element (20) being fixed to the top of the tubular element (10) having coils spaced from one another, and a second spiral-shaped conical-development element (26) being fixed near the bottom of the tubular element (10) having coils approached to one another.

8. A tubular stabilization element for the consolidation or the stabilization of rock masses, comprising a tubular hollow body (10) with a round section, having at least an open end and the opposite end (10') provided with a locking means (12) and being provided on its external surface with at least one spiral-shaped conical-development element (20, 26) having coils spaced from one another and having an increasing diameter in the direction from the open end of said tubular body to the end of said tubular body provided with a locking means whereby said at least one spiral-shaped conical development element (20, 26) facilitates filling the gap between the external surface of said tubular body (10) and the wall of a hole (22) drilled therefor with a consolidation material.

9. The tubular stabilization element according to claim 8, wherein the coils of said at least one spiral-shaped conical-development element (20, 26) are approached to one another.

10. The tubular stabilization element according to claim 8, wherein the at least one spiral-shaped conical-development element (20, 26) is fixed by welding the smallest diameter coil thereof to said tubular body.

11. The tubular stabilization element according to claim 8, comprising two spiral-shaped conical-development elements (20, 26), one of which is formed by spaced coils and the other one is formed by approached coils.

12. The tubular stabilization element according to claim 8, wherein the external surface of the tubular body (10) is provided with protrusions.

13. The tubular stabilization element according to claim 12, wherein the protrusions on the external surface of the tubular body (1) are formed by a screw pitch (32) formed by rolling.

14. The tubular stabilization element according to claim 8, wherein the external surface of the tubular body (10) is provided with a continuous thread.

15. The tubular stabilization element according to claim 8, wherein the external surface of the tubular body (10) is provided with a discontinuous thread.

16. The tubular stabilization element according to claim 8, wherein the opposite end (10') of tubular body (10) is provided with a thread for coupling the locking means (12) and is adapted to be connected to a consolidation material feeder (34).

* * * * *